United States Patent [19]

Shimizu et al.

[11] Patent Number: 4,664,289

[45] Date of Patent: May 12, 1987

[54] DRUG DISPENSING APPARATUS

[75] Inventors: Hiroyasu Shimizu; Atsuo Inamura, both of Ota; Manabu Haraguchi, Gunma, all of Japan

[73] Assignee: Sanyo Electric Co, Ltd., Moriguchi, Japan

[21] Appl. No.: 778,638

[22] Filed: Sep. 20, 1985

[30] Foreign Application Priority Data

Jun. 3, 1985 [JP] Japan ..... 60-83646[U]
Jun. 19, 1985 [JP] Japan ..... 60-92673[U]
Jun. 19, 1985 [JP] Japan ..... 60-92674[U]

[51] Int. Cl.[4] ..... B65D 83/04

[52] U.S. Cl. ..... 221/2; 221/129; 221/197; 221/233; 339/18 P

[58] Field of Search ..... 221/2, 5, 7, 129, 219, 221/233, 234, 263, 197; 339/18 R, 18 P, 31 R, 31 M

[56] References Cited

U.S. PATENT DOCUMENTS 3,079,475 2/1963 Rumble ..... 339/31 R X
3,382,475 5/1968 Kramer ..... 339/18 P
4,018,358 4/1977 Johnson et al. ..... 221/197 X
4,047,635 9/1977 Bennett ..... 221/5
4,125,309 11/1978 Grantiz et al. ..... 339/18 P
4,460,811 7/1984 Murr et al. ..... 339/18 P X

*Primary Examiner*—F. J. Bartuska
*Attorney, Agent, or Firm*—Armstrong, Nikaido, Marmelstein & Kubovcik

[57] ABSTRACT

A drug dispensing apparatus includes a drug dispensing unit and a control unit. The apparatus dispenses an individual drug dose or doses to a common collection area from one or more drug dispensing cartridges for packaging. The drug dispensing unit of the apparatus is internally provided with a plurality of shelves, each arranged one upon another. A plurality of drug dispensing cartridges are removably disposed side by side on each of the shelves. Each drug dispensing cartridge accommodates a plurality of individual identical drug doses. Each dosage is discharged from the cartridge, one at a time, through rotation of rotary members in compliance with input information from the control unit.

12 Claims, 28 Drawing Figures

DRUG DISPENSING APPARATUS

BACKGROUND OF THE INVENTION

The present invention generally relates to a drug dispensing apparatus and more particularly, to an automatically controlled drug dispensing apparatus having a drug dispensing cartridges storing unit, a drug doses packing unit and a control means, capable of dispensing an individual drug dose or doses to a common collection area from one or more drug dispensing cartridges for packaging purpose thereof.

In the drug dispensing apparatus according to the present invention, a plurality of drug dispensing cartridges are removably disposed side by side and vertically in the drug dispensing cartridges storing unit. A drug dose or doses from one or more drug dispensing cartridges properly selected in accordance with input information which is given through the control means, are collectively packaged in the drug doses packing unit. The drug dispensing unit is composed of both of the drug dispensing cartridges storing unit and the drug doses packing unit of the apparatus.

The present invention intends to provide designs of the cartridge storing the drug doses in tablet or capsule form or the like, arrangements thereof in the drug dispensing unit, constructions of the unit or the like.

With regard to the drug dispensing cartridges, a couple of prior arrangements are disclosed in Japanese Utility Model Publications (Jikkosho) No. 52-34786 and No. 56-44728.

In the case of the former arrangement, each individual drug dose can be taken out from the cartridge in such a manner that a tube for arraying the drug doses is pushed up in a drug storing portion by means of a solenoid so as to accommodate the individual drug doses therein. Since the drug doses stored in the storing portion are stirred through the push-up motion of the tube as described above, they can be steadily taken out from the cartridge. The disadvantage of this kind of means is that a large noise tends to be made with the push-up motion.

The latter arrangement contains a wheel for arraying the drug doses, whereon are arranged a plurality of grooves. The drug doses are caught on the grooves are taken out therefrom by spontaneous falling due to gravity, while the wheel is being rotated. The disadvantage of this kind of means is in its low speed for removing the drug doses using gravity, in spite of the advantage of having low noise in its operating condition, since the drug doses are taken out from the grooves by the rotation of said wheel.

In addition, a disadvantage in each of the prior art arrangements as described above resulted from the spontaneous falling of the drug doses, when they are in series at an outlet since some of them will simultaneously be discharged from the dispenser.

Furthermore, in the foregoing arrangements, the only means to detect the drug doses discharged is a direct detection thereof. A photoswitch generally adopted for this purpose sometimes misses the detection of the drug doses, although this kind of trouble depends upon a passing condition thereof. Also, the detecting ability of the photoswitch decreases when the drug doses are powdery and attaches thereon.

Accordingly, although it is desirable to obtain a drug dispensing cartridge capable of dispensing the drug doses one at a time by a means other than that of spontaneous falling to discharge the individual drug doses separately out of a drug outlet, the disadvantages of a cartridge is that it requires a long time to supply the drug doses. Moreover, when the cartridge is overloaded such as clogging of the drug dose in the taking out or discharging process thereof, the drug dose or the cartridge is undesirably damaged.

The cartridge storing unit of a prior apparatus according to another prior art arrangement, is disclosed in Japanese Utility Model Publication (Jikkosho) No. 54-22551. A plurality of drug dispensing cartridges are accommodated in the storing unit having a construction like shelves and placed thereon in a manner that the drug outlet on each drug dispensing cartridge is coincidentally arranged on each opening provided on one of the shelves for discharging the drug doses. The cartridge is electrically connected with the apparatus through a connector provided on a rear plate of the shelves.

In the case as described above, a falling passage for the drug doses discharged out of the cartridges cannot be formed behind the rear plate due to the wires that provide signals to the cartridges.

Consequently, as disclosed in Japanese Utility Model Publication (Jikkosho) No. 54-22551, it is necessary to form the falling passage under the bottom plates of the shelves. Where each cartridge is placed one upon another vertically, a stair-step-like construction of the shelves results. However, this construction is a drawback due to the large size of the drug dispensing unit of the apparatus.

In addition, Japanese Utility Model Publication (Jikkosho) No. 54-10239 discloses a drug dispensing cartridge having a guide portion and an engaging piece for an engagement thereof with one of the shelves, whereby each cartridge can be properly placed in the apparatus.

A position where a certain cartridge is placed is generally determined in conjunction with the kind of drug doses stored in the cartridge. A discharging signal is sent to the cartridge corresponding to a desired position when the drug dose or doses are discharged. The cartridge must be, therefore, properly replaced where it was, when it is taken from the apparatus for replenishment of the drug doses or the like.

Since an essential object of the above prior art is to provide a reliable electrical connection between the drug dispensing cartridge and the apparatus, even if a cartridge storing a different kind of drug doses is placed in a certain position of the apparatus, a merely correct displacement of the cartridge results in a completed electrical connection between the cartridge and the apparatus. Consequently, a mistake can arise in discharging the wrong kind of drug doses since the cartridge can be stored at any position in the apparatus.

Furthermore, Japanese Utility Model Publication (Jikkosho) No. 57-2241 discloses the drug dispensing apparatus having a construction wherein individual drug doses dispensed from each drug dispensing cartridge are led to a common falling passage. However, the above construction causes "cross contamination". That is, a collision of the drug doses dispensed from the cartridges against any of the side walls of the falling passage brings about drug powder adherent to the side walls. This results in undesirable adherence thereof to other drug doses and this is particularly undesirable for pure drug doses.

According to Japanese Utility Model Publication (Jikkosho) No. 57-2241 as mentioned above, therefore, the falling passage is easily cleaned and inspected due to the construction of the falling passage being freely opened and closed. Nevertheless, it is still difficult to clean the inner part of the falling passage in the case of a long passage of a large-sized drug dispensing unit.

SUMMARY OF THE INVENTION

Accordingly, an essential object of the present invention is to provide an improved drug dispensing apparatus having a plurality of drug dispensing cartridges accommodated in the storing unit thereof. Each of the cartridge can steadily discharge and reliably detect individual drug doses one at a time with rotation of rotary members. The apparatus can shorten the period for discharging the drug doses, and is so designed that the drug doses and the cartridge are not damaged even in case of a problem therein.

Another important object of the present invention is to provide a small-sized drug dispensing apparatus of the above described type, wherein each cartridge can be placed only at a single position registered in advance. The position is easy to find when the cartridge is accommodated in the apparatus.

A further object of the present invention is to provide a drug dispensing apparatus having a falling passage for drug doses in the dispensing unit thereof, which is easily accessible for cleaning.

In accomplishing these and other objects, according to one preferred embodiment of the present invention, there is provided a drug dispensing apparatus having a plurality of drug dispensing cartridges accommodated in the storing unit thereof. Each of the cartridges includes a driving motor turning around a supporting shaft in the same direction as a rotating direction of an output shaft thereof. A driven pulley rotates while keeping in constant contact with the output shaft of the driving motor directly or through rotation of an idler pulley which is in contact with the output shaft. A drug storing portion is provided. A rotary plate is mounted on the same shaft as the driven pulley while facing the drug storing portion at one side thereof. A guide wall has a plurality of notches at regular intervals formed on a circumference of the rotary plate at the other side thereof. A plurality of claw pieces is mounted on the rotary plate so as to be freely reciprocable in a radial direction from a central shaft of the rotary plate and each corresponding to one of the notches. A plurality of ribs are arranged at regular intervals on a circumference of the rotary plate at the side thereof facing the drug storing portion. A plurality of engaging members is mounted on the rotary plate, each having a receiving portion for the drug dose at one end thereof and corresponding to an opening between adjacent circumferential ribs so as to be capable of holding and pushing out each drug dose upon reciprocation of the engaging member in a radial direction. A parting strip is arranged between the rotary plate and the drug storing portion and has a circular opening so that the drug doses can be easily led to the inside of each rib. A stationary wall is provided on the parting strip, along just inside of which the ribs rotate while facing thereto. A drug outlet is formed on the stationary wall at a position desirable for dispensing the drug doses. A detecting means for detecting each drug dose discharged from the drug outlet is provided. A control means is provided for controlling the reciprocating movement of the engaging member inwardly pressed toward the central shaft of the rotary plate thereby, which follows the rotation of the rotary plate so that the engaging member which has come to a position for taking out the drug dose through the rotation of the rotary plate, can protrude toward the drug outlet through the opening between adjacent ribs.

With regard to a construction of the drug dispensing cartridges storing unit of the apparatus according to the present invention, there is provided a drug dispensing apparatus including a cartridges storing unit which is internally provided with a plurality of shelves arranged vertically and having a back plate and a bottom plate each, whereon a plurality of drug dispensing cartridges are placed side by side. A plurality of connectors are each arranged on the front face of one of the shelves. A drug doses falling passage is arranged behind the back plates of the shelves. A plurality of drug dispensing cartridges, is provided, each having a connector on a lower case for electrical connection with one of the connectors provided on the shelves. The cartridges so placed on the shelves that each drug outlet faces the drug doses falling passage through each opening arranged on each back plate of the shelves.

In another aspect of the present invention, the drug dispensing apparatus includes a drug dispensing unit being open at both its front and rear sides. A plurality of shelves vertically is arranged in two rows one behind the other. A drug doses falling passage is formed between the front and the rear rows of the shelves, and a plurality of drug dispensing cartridges is so placed on the shelves that each drug outlet faces the drug doses falling passage. The drug dispensing unit is separable into two along the drug doses falling passage arranged vertically.

Furthermore, on the contact face of the shelves of each drug dispensing cartridge is provided a pair of coupling groups. Each pair of coupling groups has a plurality of openings and a pair of pins capable of being selectively inserted into any one of the openings of each coupling group.

In compliance with the above, on the contact face of each shelf for the cartridge is provided a pair of openings for connection with a pair of the pins arranged on the cartridge and a connector, whereby the cartridge is electrically connected with the apparatus when the pins are completely engaged in the openings on the shelf.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE EMBODIMENTS

Figure 1:
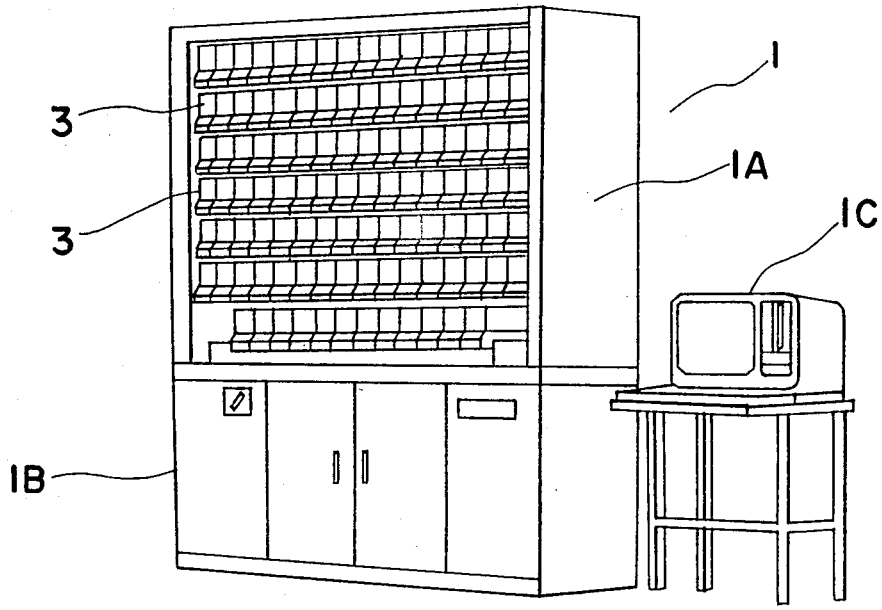
FIG. 1 is a perspective view of a drug dispensing apparatus according to one preferred embodiment of the present invention.

Before the description of the present invention proceeds, it is to be noted that like parts are designated by like reference numerals throughout the accompanying drawings.

Referring now to the drawings, a drug dispensing apparatus according to one preferred embodiment of the present invention will be described hereinafter.

FIG. 1 illustrates a drug dispensing apparatus 1 comprising a drug dispensing unit which is composed of a drug dispensing cartridges storing unit 1A and a drug doses packing unit 1B, and a control means 1C for dispensing and packing an individual drug dose or doses in compliance with input information.

Figure 2:
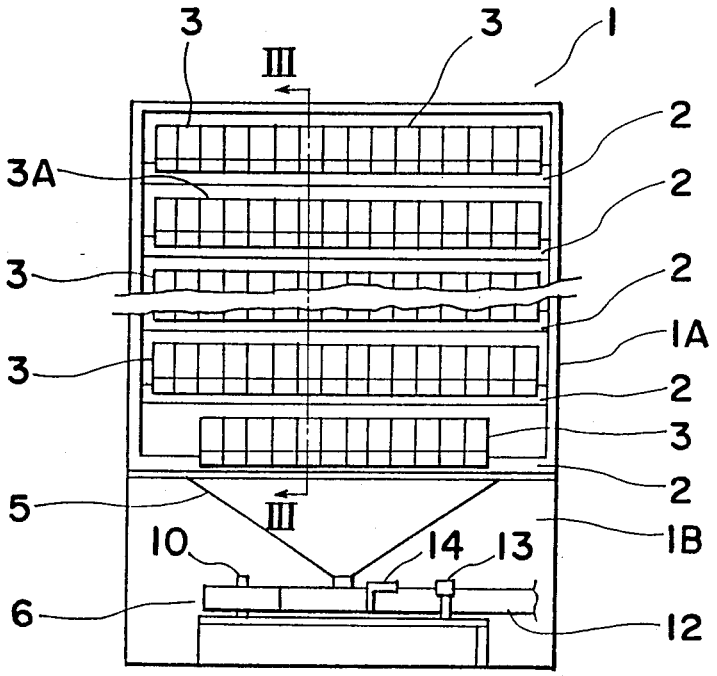
FIG. 2 is a front elevational view of the drug dispensing apparatus illustrated in FIG. 1 with the front covers of the lower portion thereof removed.
Figure 3:
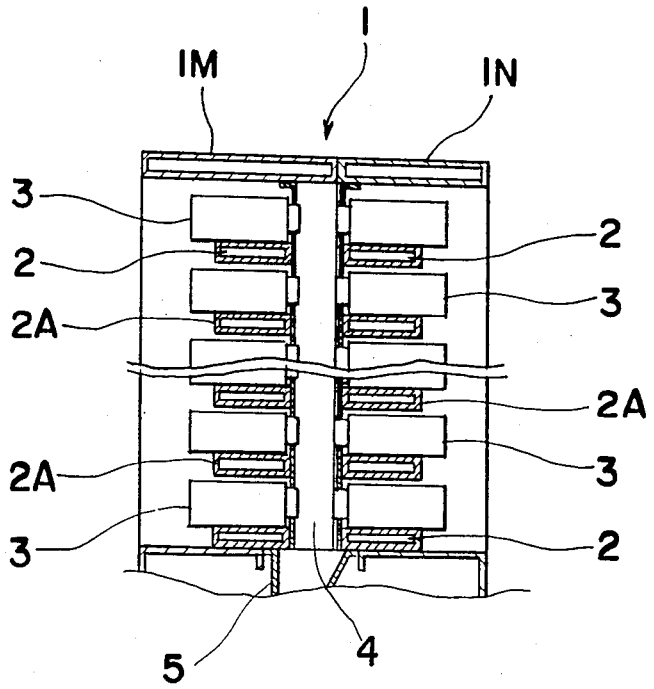
FIG. 3 is a side elevational view taken along the line III—III shown in FIG. 2.

FIGS. 2 and 3 show the essential construction of the drug dispensing unit of the apparatus. The cartridges storing unit 1A, which is open at both front and rear sides, accommodates a plurality of the drug dispensing cartridges 3 placed side by side and vertically on a plurality of corresponding shelves 2. Each shaft has a bottom plate and a back plate. The shelves are arranged in two rows one behind the other.

Each cartridge 3, detachable through one of the open sides of the storing unit 1A, is placed on one of the shelves 2 in such a manner that a drug outlet 8 of each cartridge 3 faces a drug doses falling passage 4 which is arranged between the front and the rear rows of the shelves.

In the packing unit 1B, there is provided a hopper 5 in connection with the drug passage 4 for collecting the drug doses from the cartridges 3 and a packing mechanism 6. The drug doses are led into a packaging paper which is pulled out by a feed roller 13 from a roller 10 on which the packaging paper folded in two, is wound up, so that the drug dose or doses selectively discharged are pouched through heating by a heat seal device 14.

Figure 4:
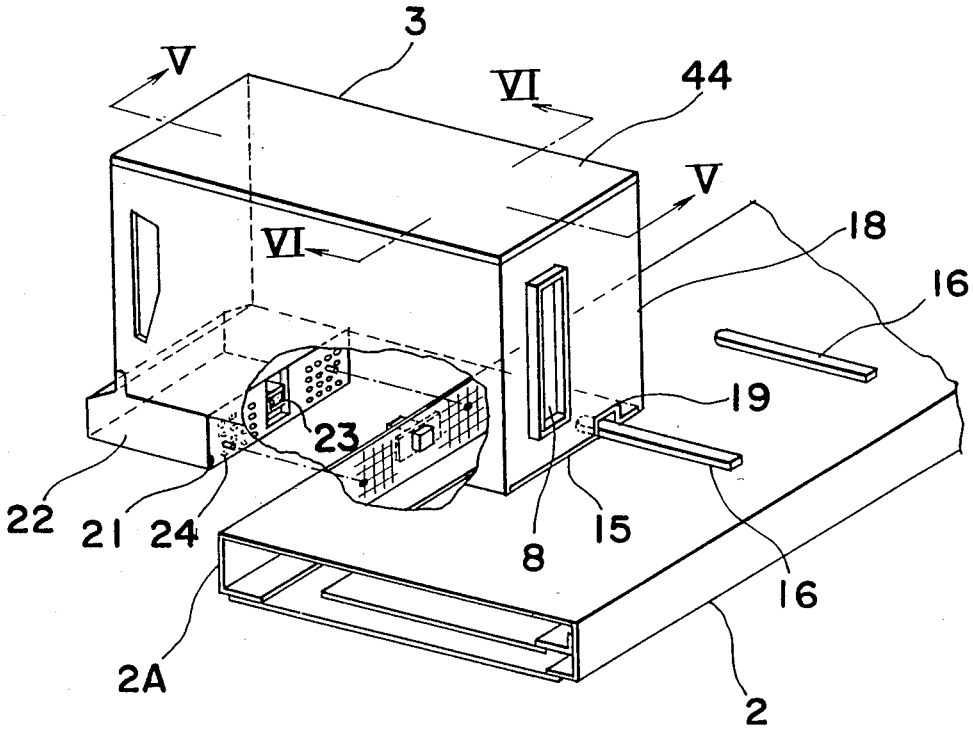
FIG. 4 is a perspective view of a drug dispensing cartridge disclosed in FIGS. 1 through 3, illustrating the connection between the cartridge and a portion of one of the shelves in the drug dispensing apparatus, with portions thereof broken away.

FIG. 4 shows a connection between the cartridge 3 and a portion of one of the shelves 2 in the drug dispensing unit. A groove 19 is provided in a bottom surface 15 of each cartridge 3. The groove 19 engages with one of guide rails 16 formed on the shelf 2. Each cartridge 3 is properly placed in the drug dispensing unit through the engagement between the groove 19 and the guide rail 16.

The cartridge 3 is provided with a lower casing 22 which is in contact with a front face 2A of the shelf 2. The cartridge 3 has a connector 23 as well as a plurality of openings 24 whereby the cartridge is electrically connected with the drug dispensing apparatus 1 and properly addressed thereto. Detailed explanations for the connector and the openings will be made later.

Figure 5:
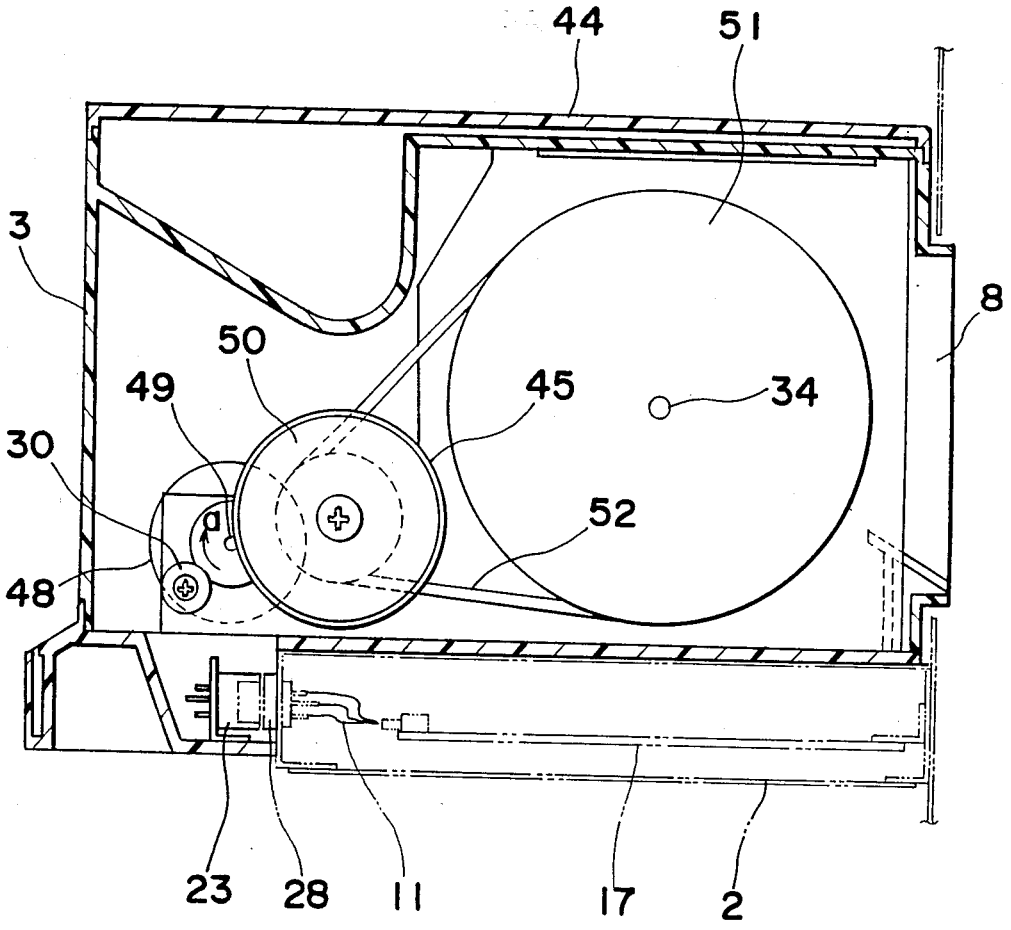
FIG. 5 is a side sectional view on an enlarged scale, taken along the line V—V in FIG. 4.
Figure 6:
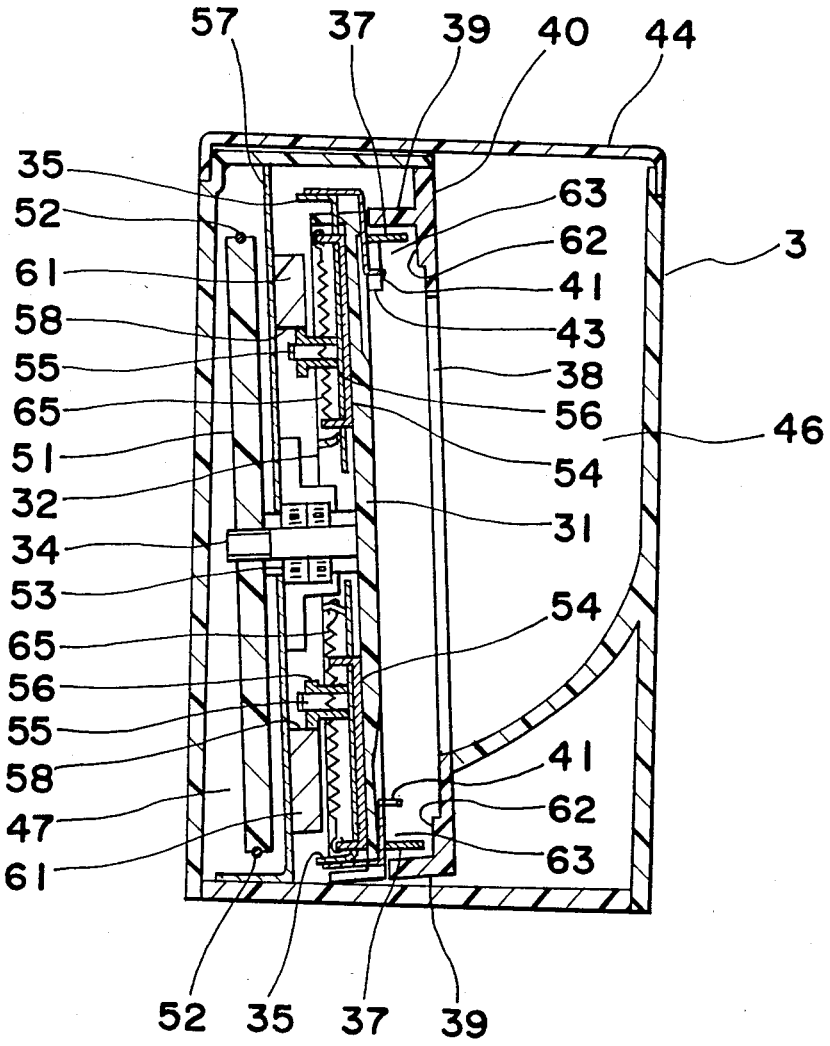
FIG. 6 is a cross sectional view on an enlarged scale, taken along the line VI—VI in FIG. 4.

FIGS. 5 and 6, show the drug dispensing cartridge 3 with a cover 44. The cartridge 3 has a drug storing portion 46 and a driving portion 47, both of which are partitioned by the parting strip 40. The drug doses are replenished through an upper open side of the drug storing portion 46 which is normally closed by the cover 44.

In the driving portion 47 as illustrated in FIG. 5, a driving motor 48 is mounted on a supporting shaft 30 to turn in the same direction as a rotating direction of an output shaft 49 shown by an arrow a. An idler pulley 50 has a rubber ring 45 on its peripheral portion. The rubber ring 45 of the idler pulley 50 is in contact with the output shaft 49. The idler puller 50 is linked to a driven pulley 51 through a belt 52. In FIG. 5, double dotted chain lines show a connector 28, lead wires 11 and a control circuit plate 17 in one of the shelves 2.

Figure 8:
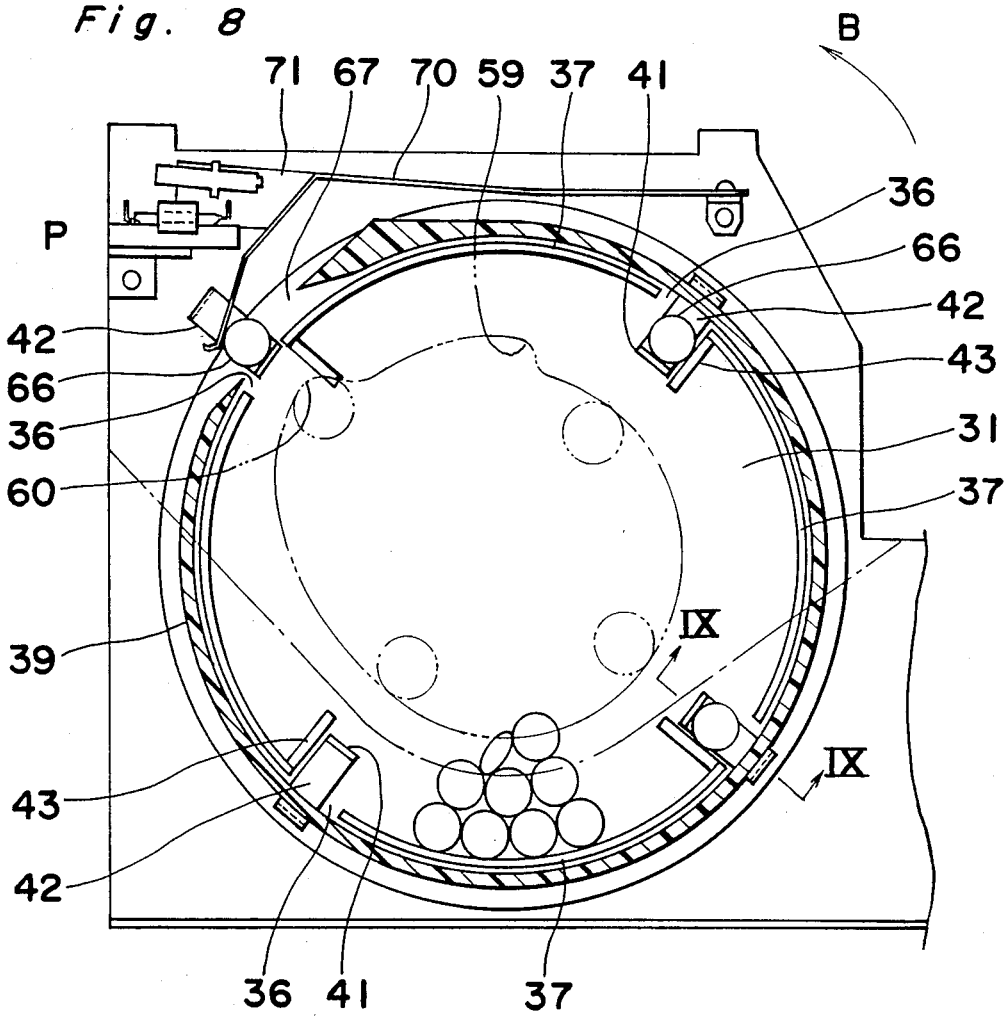
FIG. 8 is a side view of the rotary plate showing the other side thereof whereon the rotary plate is provided with a plurality of ribs, an engaging state between the ribs and the stationary wall, and the drug doses detecting means.

Upon connection of both the connectors 23 and 28, the driving motor 48 is electrically connected with the control circuit plate 17 through the lead wires 11 so as to be in a controllable state. A rotary plate 31 is installed on a rotary shaft 34 of the driven pulley 51. The plate 31 is supported by bearings 53. On one face of the circumference of the rotary plate, a guide wall 32 protrudes toward the driven pulley 51 On a circumference of the rotary plates's reverse side, ribs 37 protrude toward the drug storing portion 46. As shown in FIG. 8, said ribs 37 are divided into four pieces at regular intervals. The ribs 37 just inside of a stationary wall 39 when the rotary plate rotates The stationary wall 39 is provided on the parting strip 40.

A drug outlet 67 is arranged at an appointed position of the stationary wall 39 so that each drug dose can be dispensed when an opening 36 between adjacent ribs 37 comes to a position facing the outlet 67. On the other hand, four sets of claw pieces 35 are freely reciprocatable between a pair of guide plates 54, are arranged at regular intervals, i.e., at intervals of an angle of 90°, so as to reciprocate in a radial direction from the rotary shaft 34. The claw pieces 35 are located on the face where the guide wall 32 is provided on the rotary plate 31.

The guide wall 32 is provided with four notches 33, each of which is opposed to a corresponding end of each claw piece 35. Each claw pieces 35 has a shaft 55 and roller 56 rotatably supported on each shaft 55.

Between the driven pulley 51 and the rotary plate 31 is arranged a stationary plate 57. A cam 61 is rigidly mounted on stationary plate 57. An inner circumferential wall 58 of the cam 61 has such a shape as shown by a double dotted chain line in FIGS. 7 and 8.

The claw piece 35 is urged to protrude in an outward direction from the rotary plate 31 through the notch 33 by means of a spring 65. Accordingly, the roller 56 moves along the inner circumferential wall 58 of the cam 61 according to the rotation of the rotary plate 31, while keeping in constant contact with the inner circumferential wall 58.

Therefore, the reciprocating motion of the claw piece 35 is controlled in compliance with the shape of the inner circumferential wall 58 of a cam 61 having the first concave portion 59 and a second concave portion 60. When the roller 56 comes into contact with the second concave portion 60 of the inner circumferential wall 58 of the cam 61, the claw piece 35 protrudes to the outward direction over the rotary plate 31 through the notch 33.

Figure 9:
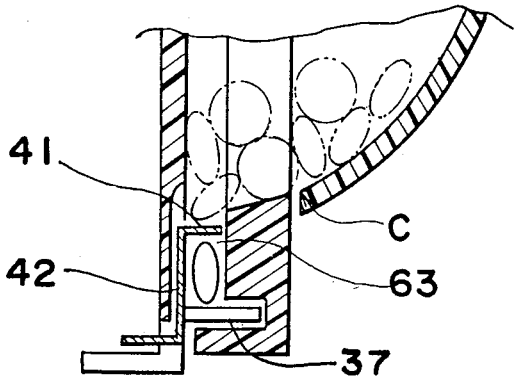
FIG. 9 is a fragmentary cross sectional view of the drug dispensing cartridge on an enlarged scale, taken along the line IX—IX in FIG. 8.
Figure 10:
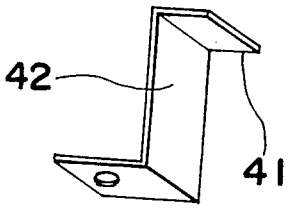
FIG. 10 is a perspective view of a claw piece, on an enlarged scale, which is applied to the drug dispensing cartridge for the drug doses in table form.

Each of a plurality of engaging members 42 reciprocating in a radial direction on the face of the rotary plate 31 where the ribs 37 are formed. The engaging member 42 has one bent end mounted on the end of one of the claw pieces 35, with that end of the member 42 being bent toward the driven pulley 51. The other bent end of member 42 forms a receiving portion 41 for the drug doses, with that other bent end being bent toward the drug storing portion 46 as shown in FIGS. 8–10.

The cam 61, the spring 65 and the roller 56 are so arranged respectively that, when the claw piece 35 protrudes in the outward direction over the rotary plate 31 through the notch 33, the receiving portion 41 for the drug doses also protrudes to a position where the ribs 37 are arranged so as to discharge the drug doses.

In such a manner as mentioned above, the drug doses are discharged through the function of control members moving with the rotation of the rotary plate 31. Accordingly to the present embodiment, the control members comprise the spring 65 urging the claw piece 35 outwardly in a radial direction at all times, the roller 56 mounted on the claw piece 35 and the cam 61 having an inner circumferential wall 58 on and along which, the roller moves, while keeping in contact therewith.

As shown in FIG. 8, furthermore, on the face where the rotary plate 31 is provided with the ribs 37, a guide plate 43 is arranged along a travelling passage of the receiving portion 41 of the claw piece 35 upon reciprocation thereof.

When the drug doses stored in the drug storing portion 46 of the cartridge 3 are in tablet form, the parting strip 40 is provided with a circular opening 38 having approximately the same radius as the distance between the receiving portion 41 and the shaft 34. When the receiving portion 41 closely approaches the shaft 34, the drug storing portion 46 leans through the opening 38 toward the face of the rotary plate 31 where the rotary plate 31 has the receiving portion 41 of the claw piece 35.

An annular groove 63 is formed in the space defined by the ribs 37 and the circumferential side 62 of the opening 38 due to the radius of the opening 38 than being smaller the distance between the rib 37 and the shaft 34. Since the bottom of the drug storing portion 46 is inclined towards the opening 38, the drug doses are led to the rotary plate 31 from the drug storing portion 46 through the opening 38 so as to be lined up along the groove 63 between the ribs 37 and the circumferential side 62 of the opening 38.

FIG. 9 is a cross sectional view, taken along the line IX—IX shown in FIG. 8, illustrating one of the drug doses in tablet form retained in the engaging member 42 and the guide plate 43 after the above mentioned line-up thereof along the groove 63.

A single dotted chain line in FIG. 8 shows an edge line of the inclined bottom of the drug storing portion 46, as indicated by C in FIG. 9.

FIG. 10 shows the engaging member 42 for the drug doses in tablet form made up of a plate having its opposite ends, one of which forms a receiving portion 41, bent at right angles thereto so as to extend in opposite directions away from each other.

Figure 11A:
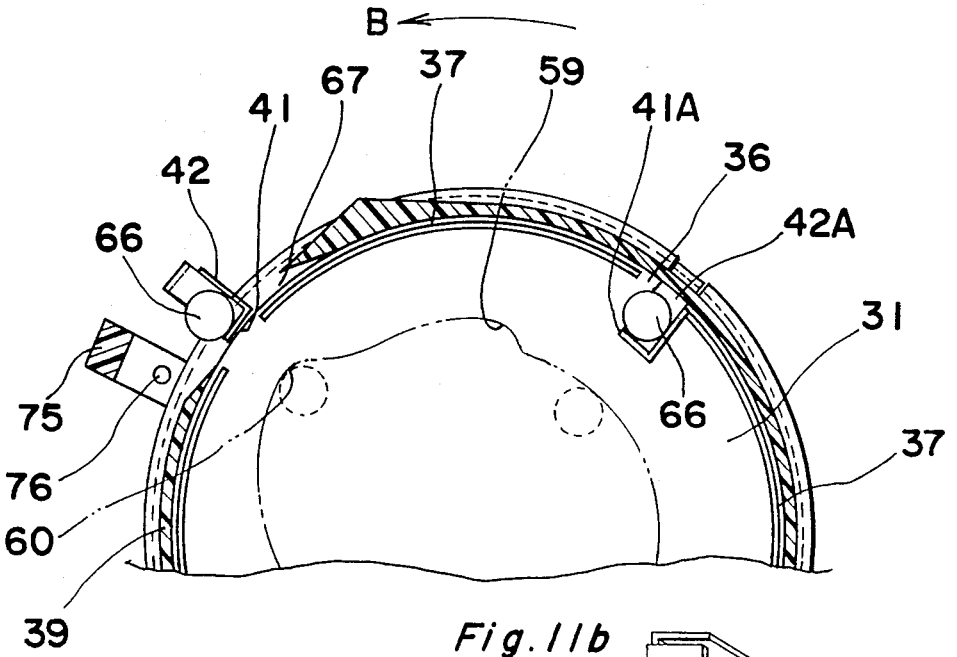
FIG. 11*a* is a portion of a side view similar to FIG. 8, showing a modification of the claw piece.
Figure 11B:
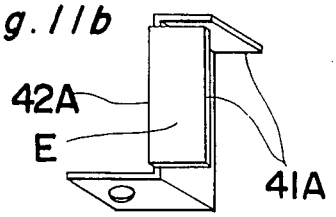
FIG. 11*b* is a perspective view of the claw piece, on an enlarged scale, illustrated in FIG. 11*a;*

FIGS. 11*a* and 11*b* show a modification of the engaging member 42A. In the modified engaging member 42A, an additional bent portion E is arranged thereon so as to form an L-shaped receiving portion 41A for the purpose of deleting the guide plates 43 in FIG. 8.

Figure 12:
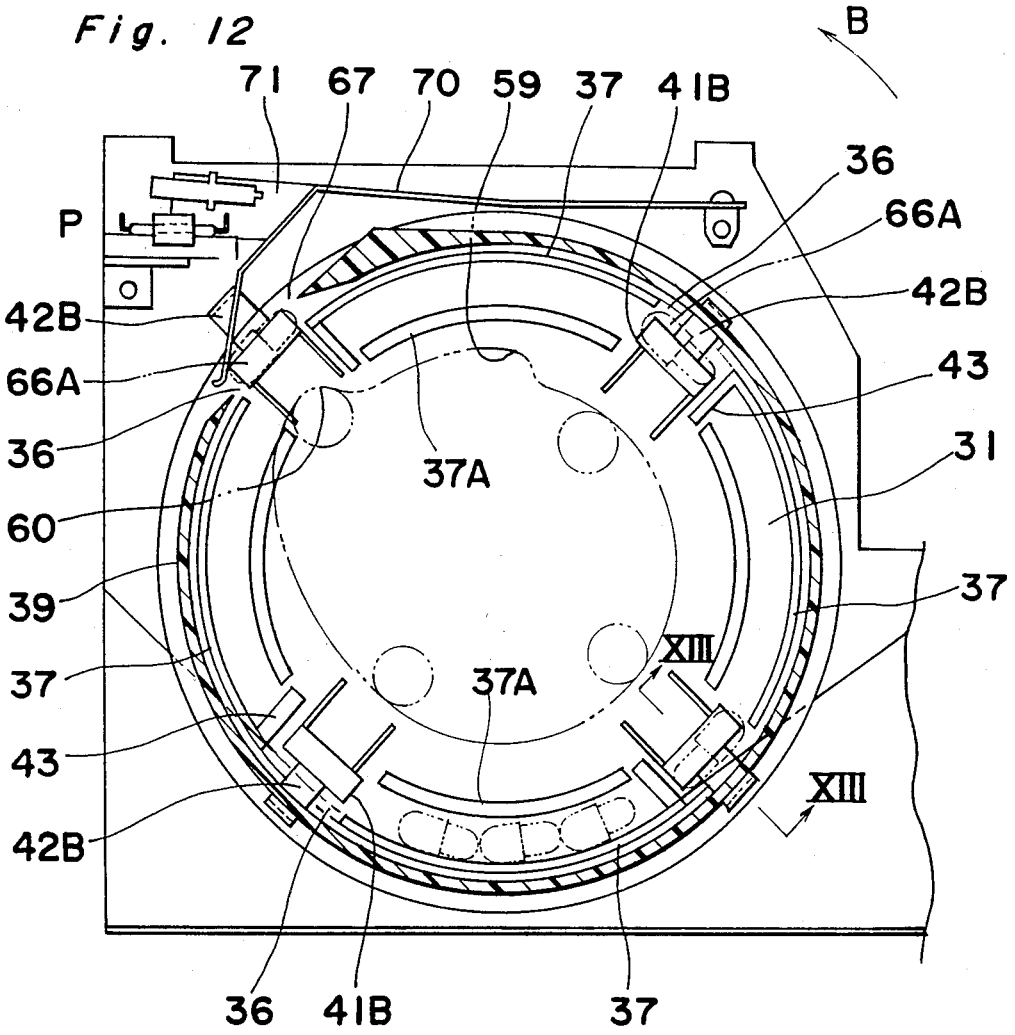
FIG. 12 is a side view of the rotary plate of the second embodiment of the present invention, similar to FIG. 8.
Figure 13:
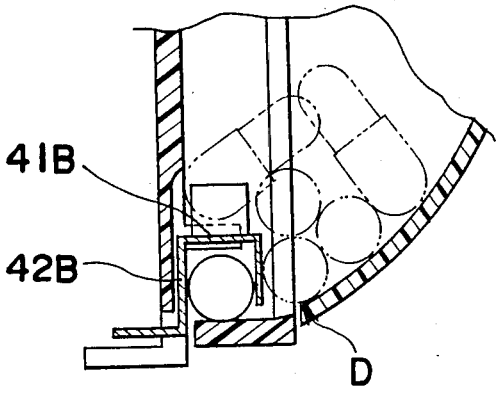
FIG. 13 is a cross sectional view of the drug dispensing cartridge on an enlarged scale, taken along the line XIII—XIII in FIG. 12.
Figure 14:
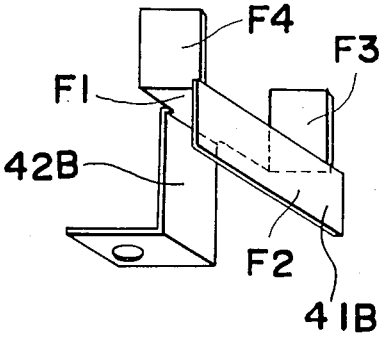
FIG. 14 is a perspective view of the claw piece, on an enlarged scale, which is applied to the drug dispensing cartridge for the drug doses in capsule form.

FIGS. 12, 13 and 14 show another embodiment of the cartridge for the drug doses in capsule form, corresponding to FIGS. 8, 9 and 10, respectively. As shown in FIG. 12, additional ribs 37A divided into four sections are provided inside of the ribs 37 on the rotary plate 31. The ribs 37A protrudge toward the drug storing portion 46 along with the ribs 37. The drug doses in capsule form are lined up in a space between both of the ribs 37 and 37A, so as to be retained on the engaging member 42B illustrated in FIG. 13. A single dotted chain line in FIG. 12 shows an edge line of the inclined bottom of the drug storing portion 46, as indicated by D in FIG. 13. Since the radius of the opening 38 in this case is approximately equal to the distance between the rib 37 and the shaft 34, the drug doses in capsule form are led into the above mentioned space between both of the ribs 37 and 37A from the drug storing portion 46. In FIG. 14, there is illustrated another modification of the engaging member 42A for the drug doses in capsule form made up of a plate having one end bent at right angles thereto and the other end forming a receiving portion 41B with four faces F1, F2, F3 and F4.

In the above receiving portion 41B, each drug dose in capsule form is retained on two of the faces F1 and F2, and the other two faces F3 and F4 are provided so as not to pinch one of the other drug doses between the engaging member 42A and the additional ribs 37A.

Figure 15:
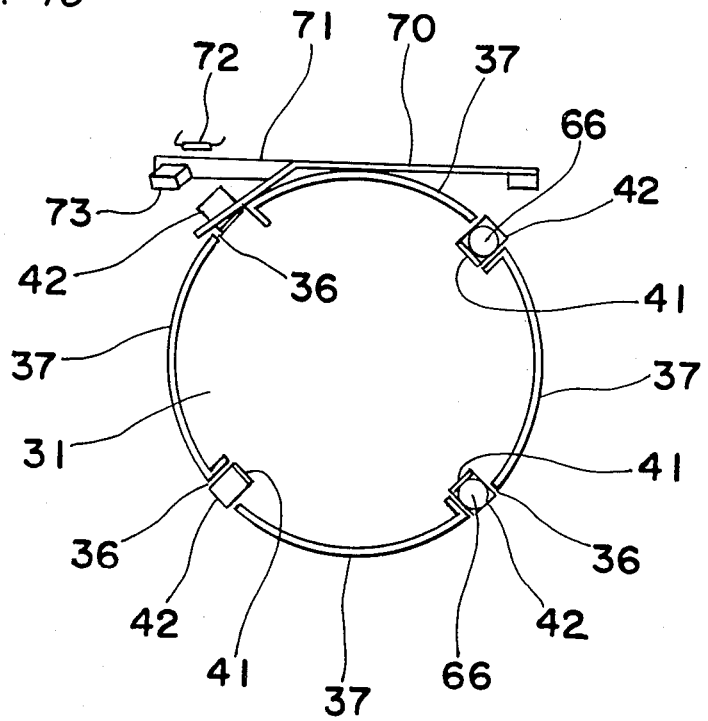
FIG. 15 is a diagram showing a state wherein the shielding plate of the elastic member intercepts the reed switch from the magnet.
Figure 16:
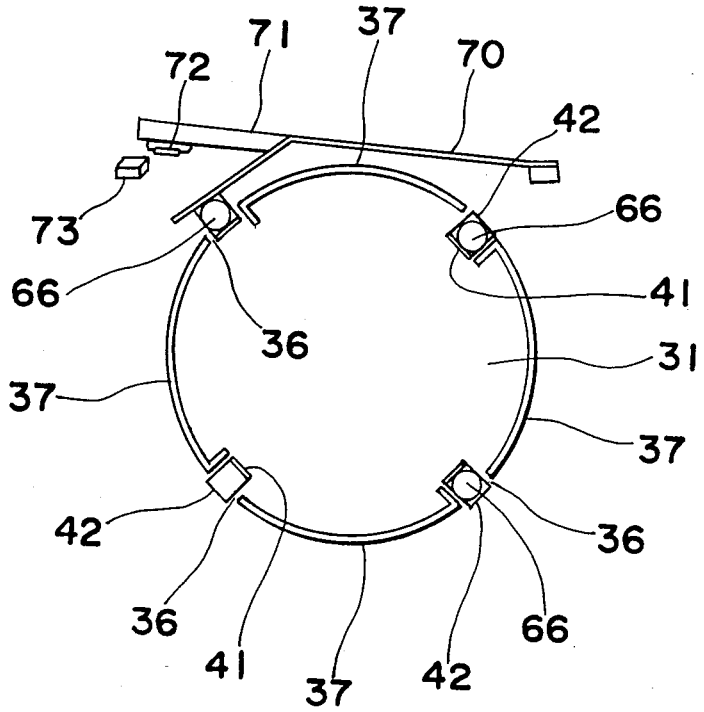
FIG. 16 is a diagram similar to FIG. 15, showing a state wherein the reed switch faces the magnet.
Figure 18:
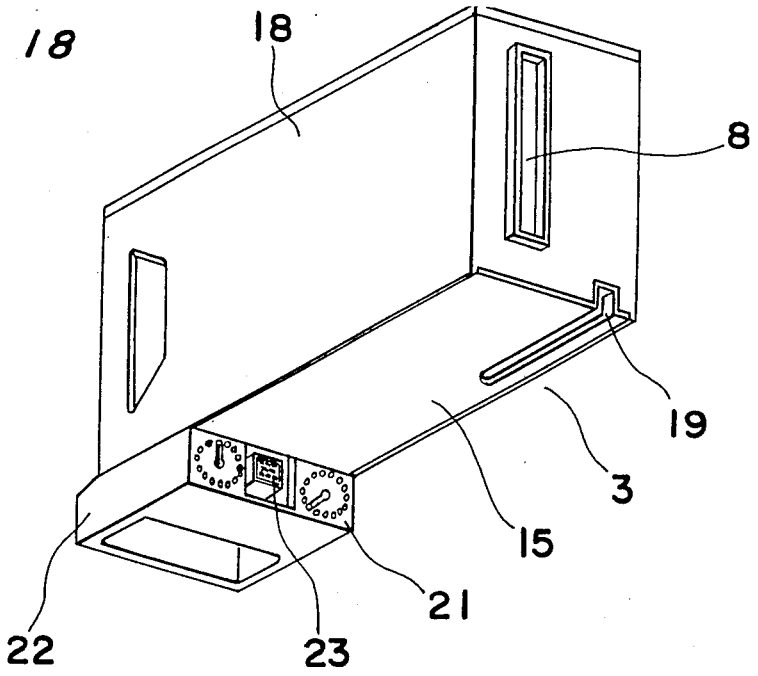
FIG. 18 is a perspective view of the cartridge with the lower case having a connector and a plurality of openings arranged in a circular state at the contact face thereof with one of the shelves in the apparatus.

In addition, an elastic member 70 supported from a stationary member outside of the rotary plate 31, is arranged at the drug outlet 67 to elastically close the outlet 67 As shown in FIGS. 12, 15 and 16, a reed switch 72 and a magnet 73 are also arranged in the vicinity of the drug outlet 67. A shielding plate 71 is disposed on the elastic member 70 and designed to extend between the reed switch 72 and the magnet 73 when the elastic member 70 closes the drug outlet 67.

A detecting means for detecting each drug dose discharged from the drug outlet 67 is composed of the elastic member 70 having the shielding plate 71, the reed switch 72 and the magnet 73 as described above. The driving motor 48, and the detecting means are also electrically connected with the control circuit plate 17, upon connection of both of the connectors 23 and 28.

As shown in FIG. 11*a*, the cartridge 3 has the engaging member 42A with an L-shaped receiving portion 41A. A photoswitch 75 may be used as the detecting means. The photoswitch 75 comprises a light emitting element 76 and a light receiving element (not shown) arranged on the falling passage of the drug doses discharged from each cartridge 3. Since the elastic member 70 cannot be used because the shielding plate 71 thereof would be moved by each receiving portion 41A of the engaging member 42A and not by each drug dose discharged from each cartridge 3.

The function of the drug dispensing cartridge 3, having the construction as described so far will be explained hereinafter. The drug doses, supplied from the upper side of the drug dispensing cartridge 3, are not only stored in the drug storing portion 46, but led to the rotary plate 31 through the opening 38 so as to be lined up along the groove 63 formed between the ribs 37 and the circumferential side 62 of the opening 38.

When the driving motor 48 is operated in compliance with a predetermined signal for discharging the drug dose or doses, the idler pulley 50 rotates in a direction to the direction shown by arrow a as well as to the driven pulley 51 while keeping in constant contact with the output shaft 49 at its circumferential edge directly.

At this stage, since the main body of the driving motor 48 turns in the direction shown by arrow a on the pivotal shaft 30, the output shaft 49 bites into the circumferential edge of the idler pulley 50 and, consequently, a transmitting force between the two is increased. On the other hand, when the driving motor 48 is not in motion, stress does not occur on the circumferential edge of the idler pulley 50, since a turning force is not generated around the pivotal shaft 30 and the idler pulley 50 is in contact with the output shaft 49 of the driving motor 48 only by the weight thereof.

Figure 7:
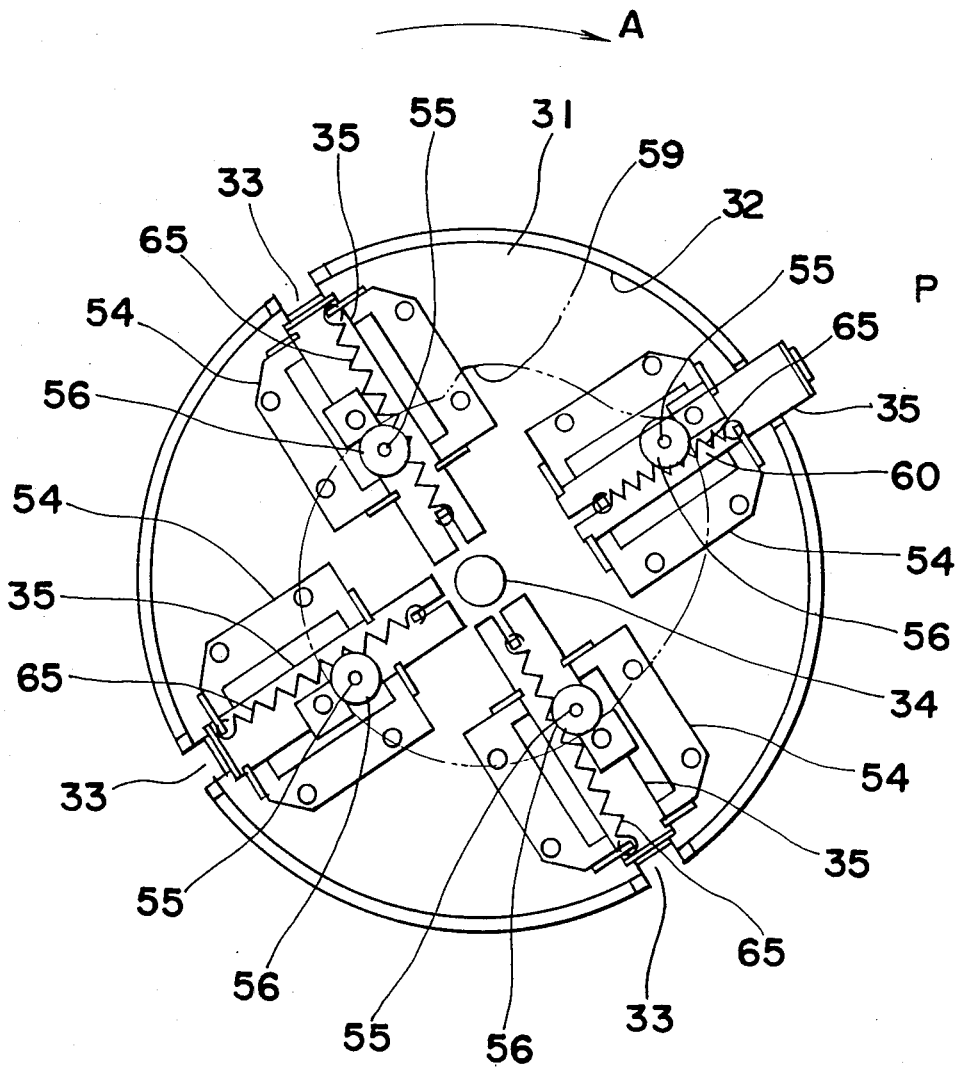
FIG. 7 is a side view of the rotary plate of the cartridge showing one side thereof whereon the rotary plate is provided with a plurality of claw pieces.

In FIG. 7, the rotary plate 31 driven by the driving motor 48 rotates in a direction show by arrow A. The claw piece 35 comes to a position P for dispensing a drug dose with the rotation of the rotary plate 31 the claw piece 35 protrudes outwardly over the rotary plate 31 through the corresponding notch 33, since the roller 56 is pressed to the second concave portion 60 of the cam 61 by means of the spring 65. The other claw pieces 35 are drawn back towards the shaft 34 due to the reciprocating motion of each claw piece 35 being restricted by the cam 61 through roller 56.

FIG. 8, corresponding to FIG. 7, illustrates the face where the rotary plate 31 is provided with the ribs 37. An arrow B shows the rotating direction of the rotary plate 31. FIG. 8, shows the drug doses lined up along the rib 37 situated at the lower portion of the rotary plate 31. A drug dose at the rearmost position in the rotating direction is retained by the guide plate 43 and the receiving portion 41 which is drawn back towards the shaft 34 with the rotation of the rotary plate 31. The drug dose is transferred to the drug takeout position P along the stationary wall 39.

Upon rotation of the rotary plate 31, when the roller 56 comes into contact with the first concave portion 59 of the cam 61, the claw piece 35 has the roller 56 slightly move toward the corresponding notch 33. and consequently, the drug dose 66, retained on the receiving portion 41, is pushed toward the stationary wall 39 as the engaging member 42 moves in the same direction. Accordingly, when a drug dose is incompletely retained on the receiving portion 41, it is reformed into a desirable condition by the movement toward the stationary wall 39. Subsequently, when the roller 56 contacts the second concave portion 60 of the cam 61, the receiving portion 41 protrudes outwardly in a radial direction. The claw piece 35 with the roller 56 protrudes over the rotary plate 31 through the corresponding notch 33 to discharge the drug dose out of the drug outlet 67. Since the receiving portion 41 comes to approximately the same position as the rib 37, the drug dose retained thereon is led to the outside of the rotary plate 31 along the guide plate 43.

Thereafter, as the rotary plate 31 rotates still more, the roller 56 contacts the second concave portion 60, and the roller 56 comes into contact with an ordinary inner circumferential wall 58 of the cam 61 other than the concave portions 59 and 60.

At this stage, the claw piece 35 is drawn back toward the shaft 34 against the spring 65 under the restriction of the cam 61 so that it becomes possible to retain one of the other drug doses being lined up along the rib 37. According to the present embodiment, one drug dose at a time can be taken out every quarter turn of the rotary plate 31 since four sets of claw pieces 35 are provided. The drug doses are steadily discharged out of the drug outlet 67 in such a manner that the drug doses, being lined up along the groove 63 formed between the ribs 37 and the circumferential side 62 of the opening 38, are dispensed one by one by the receiving portions 41 so as to be desirably retained therein.

As shown in FIG. 15, in the function for discharging the drug doses described so far, when the elastic member 70 is not urged outwardly by the drug dose, the shielding plate 71 separates the reed switch 72 from the magnet. This results in the closure of the drug outlet 67 by the elastic member 70. Accordingly, since the magnetic flux from the magnet 73 to the reed switch 72 is shut off, the reed switch 72 is in an off state. As illustrated in FIG. 16, when the elastic member 70 is moved outwardly by the drug dose 66 being pushed out by the engaging member 42, the reed switch 72 and the magnet 73 come face to face with each other. Since the shielding plate 71 moves upwards, the reed switch 72 is turned on. Thereafter, when the drug dose 66 is discharged from the engaging member 42 protruding through the opening 36, the shielding plate 70 closes the drug outlet 67 again the shielding plate 70 separates the reed switch 72 from the magnet 73 resulting in the reed switch 72 being turned off. The above mentioned changeover of the reed switch 72 from on to off is a drug detecting signal for controlling the drug dispensing apparatus 1. In other words, one of the drug doses is dispensed by stopping the driving motor 48 at the time the drug detecting signal arises. Afterward the driving motor 48 is driven in compliance with drug discharging signals. When a plurality of drug doses are dispensed, the driving motor 48 is stopped when the number of drug detecting signals have reached a predetermined number of the drug doses to be dispensing.

Figure 17:
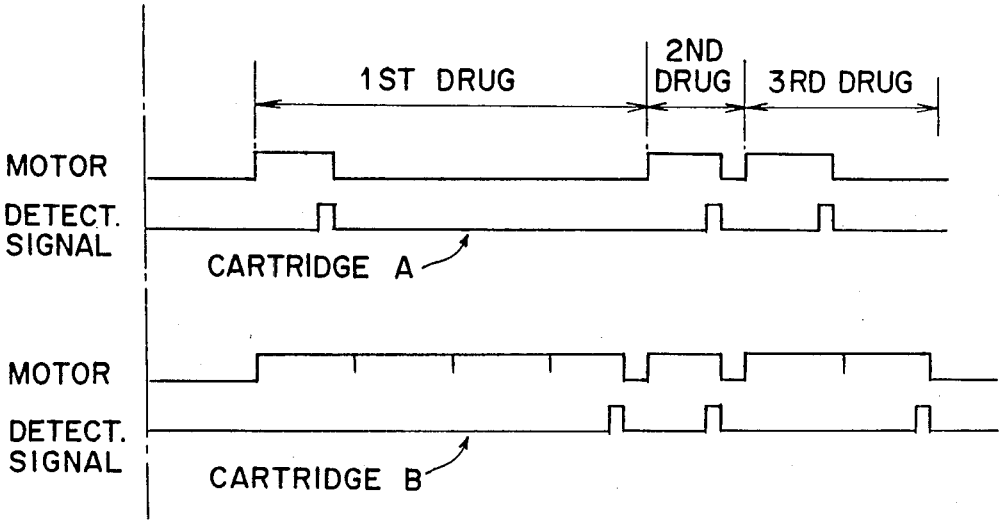
FIG. 17 depicts two timing charts for the driving motor and the drug dose detecting signal showing an example wherein two kinds of the drug doses are discharged from the drug dispensing cartridges.

FIG. 17 shows two timing charts for the driving motor and the drug doses detecting signal. The example shows three drug doses dispensed from a drug dispensing cartridge A and another three drug doses dispensed from a cartridge B, for clearly explaining the above described process.

As shown in FIG. 17, each driving motor 48 upon being ordered by the control means 1C starts rotating so as to stay in motion until one of the drug doses discharged from the cartridge is detected, and is driven again for discharging the next one of the drug doses after a brief stop thereof. With like processes being repeated, each driving motor 48 is completely stopped when three drug doses are discharged from each cartridge 3.

As is seen from the foregoing description, since each of the drug doses is discharged out of the drug dispensing cartridge 3 through the reciprocating movement of the engaging member 42 in a radial direction with rotation of the rotary plate 31, an overload is produced when the reciprocating movement of the engaging member 42 is locked by a clogging drug dose.

According to the present invention, however, since the above mentioned overload results in slippage of the output shaft 49 on the outer peripheral portion of the idler pulley 50, neither the clogging drug dose nor the drug dispensing cartridge 3 is damaged. Although, in the present example, the torque from the output shaft 49 of the driving motor 48 is transmitted to the driven pulley 51 via the idler pulley 50, an identical effect can be obtained by bringing the output shaft 49 of the driving motor 48 into contact with the outer peripheral portion of the driven pulley 51 directly without provision of the idler pulley 50.

FIGS. 18 through 21 show the drug dispensing cartridge 3 with a first embodiment of the lower case 22 having a connector 23 and a plurality of openings 24 on the contact face between the cartridge 3 and one of the shelves 2 in the drug dispensing unit of the apparatus 1, as has been stated.

Figure 19:
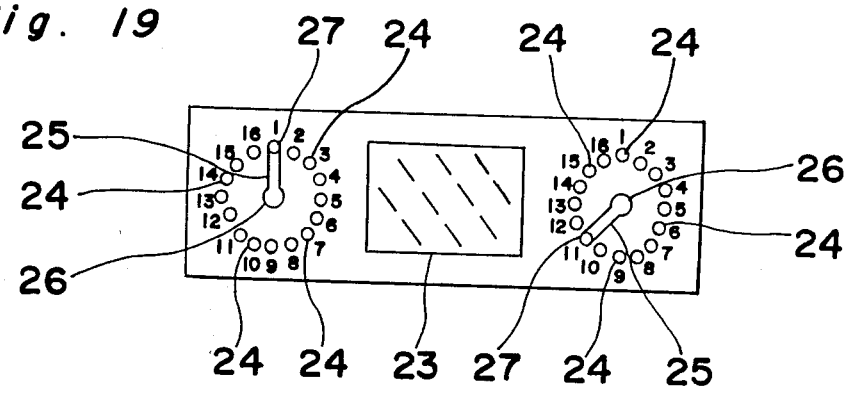
FIG. 19 is a detailed view of the contact face, on an enlarged scale, illustrated in FIG. 18.
Figure 20:
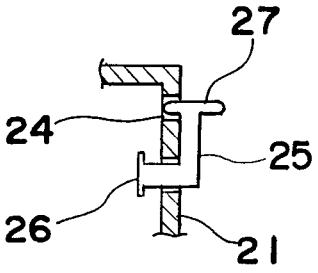
FIG. 20 is a detailed view of the pin, on an enlarged scale, engaging with one of the openings illustrated in FIG. 19.

As shown in FIG. 19, a plurality of the openings 24 are arranged in a circular state at regular intervals. At the center of the circle a rotary shaft 26 is mounted. One end of shaft 26 forms a lever 25 having at the other end a pin 27 for inserting in one of the openings 24. It is, therefore, possible to insert the pin 27 into any one of the openings 24 selectively by rotating the lever along the circle.

Figure 21:
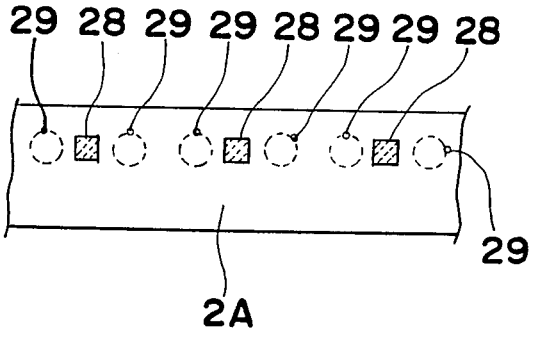
FIG. 21 is a front view of one of the shelves accommodated in the apparatus, whereon the cartridge illustrated in FIG. 18 is placed.
Figure 22:
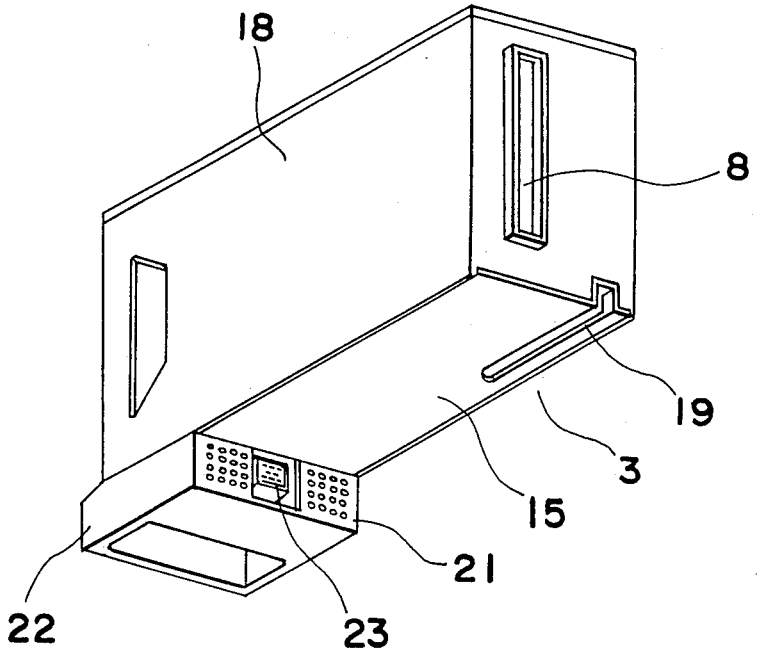
FIG. 22 is a perspective view of the cartridge similar to FIG. 18, having a connector and a plurality of openings arranged in a matrix-like state on the lower case thereof.

According to the present example, a pair of such arrays of 16 openings 24 and a pin 27 can produce 256 (16×16) combinations. In FIG. 21, the front surface 2A of one of the shelves 2 is provided with a plurality of groups of a connector 28 and a pair of openings. Each opening engaging with one of the pins 27. The positions of the openings correspond to those of a pair of pins 27 arranged on the drug dispensing cartridge 3 to be placed thereon. In other words, a pair of openings 24 of the cartridge 3, into which a pair of pins 27 are inserted, are determined in compliance with the kind of drug doses to be stored therein. A pair of engaging openings 29 are formed on the front surface 2A of the shelf 2 where the cartridge 3 is placed, while facing a pair of the openings 24 determined as mentioned above. Accordingly, when the corresponding cartridge 3 is placed at the proper position on one of the shelves 2 in the apparatus 1, the cartridge 3 is electrically connected with the apparatus 1 through the connectors 23 and 28, since a pair of pins 27 engage with a pair of engaging openings 29 formed on the front surface 2A of one of the shelves 2.

Since no engagement between the pins 27 and the engaging openings 29 results from improper placement of the cartridge 3 on one of the shelves 2, the cartridge 3 cannot be inserted for a complete electrical connection with the apparatus 1 through a connection only between the connectors 23 and 28. As a result, no erroneous dispensing or extraction of the drug dose arises from the cartridge 3 placed improperly on one of the shelves 2, since a signal for dispensing the drug dose is not led to the cartridge 3. Furthermore, in the preceding case, an operator for the drug dispensing apparatus 1 can previously find out such an error as mentioned above due to no engagement between the pins 27 and the engaging openings 29.

FIGS. 22 through 25 illustrate the drug dispensing cartridge 3 with a second embodiment of the lower case 22 which comprises a connector 23 and a pair of number setting portions 20A and 20B having a plurality of openings arrayed in a matrix-like state each on the contact surface between the cartridge 3 and one of the shelves 2 in the drug dispensing unit.

Figure 23:
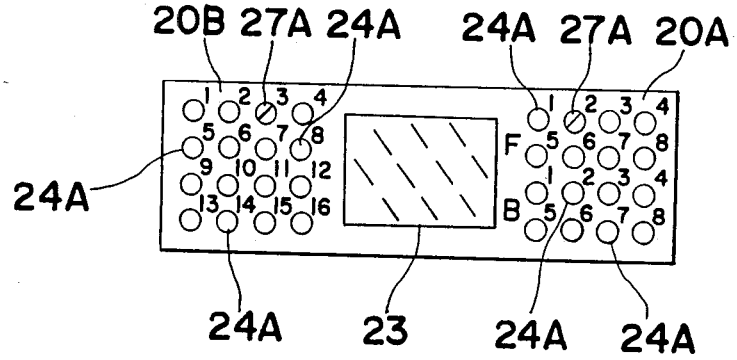
FIG. 23 is a detailed view of the contact face on an enlarged scale, illustrated in FIG. 22.

According to the present example as shown in FIG. 23, a pair of the number setting portions 20A and 20B each having 16 openings 24A and a pin 27A, can also produce 256 (16×16) combinations.

The description will now be made in connection with the cartridge 3 having the above described structure to the drug dispensing apparatus provided internally with a plurality of shelves arranged in two rows, one behind the other, as shown in FIGS. 1 and 2.

As shown in FIG. 23, the number setting portion 20A comprises 8 openings 24A in 2 upper lines. Each correspond to one of 8 rows of front side shelves 2, and 8 openings 24A of 2 lower lines, each correspond to one of 8 rows of rear side shelves 2, for setting the number of each shelf 2.

The number setting portion 20B comprises 16 openings 24A, each corresponding to one of 16 cartridges 3 to be placed on one of the shelves 2, for setting the number of each position whereon each cartridge 3 is placed.

Figure 24:
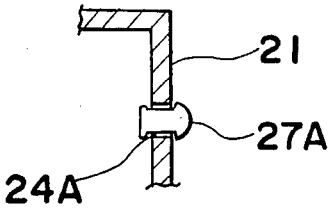
FIG. 24 is a detailed view of the pin, on an enlarged scale, being inserted into one of the openings illustrated in FIG. 23.

As shown in FIG. 24, each of a pair of pins 27A is inserted into each one opening 24A of a pair of the number setting portions 20A and 20B for indicating both the shelf number and the position number of the cartridge 3 according to the position of the cartridge 3 to be placed. The cartridge 3 can be shifted to another position by replacing a pin or pins 27A.

Figure 25:
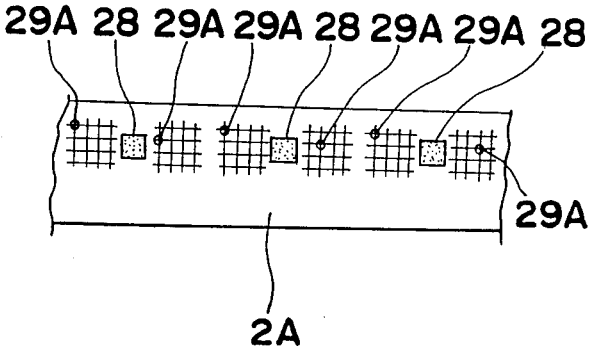
FIG. 25 is a front view of one of the shelves in the apparatus, whereon the cartridge illustrated in FIG. 22 is placed.

In the cartridge 3A at the third position from the left on the second front side shelf from the top in FIG. 2, for example, a pin 27A is inserted into an opening 24A on the number setting portion 20A which indicates 2 as a shelf number and another pin 27A is also inserted into another opening 24A on the number setting portion 20B which indicates 3 as a position number of the cartridge 3. In FIG. 25, at the front surface 2A of one of the shelves are provided a plurality of groups comprising a connector 28 and a pair of engaging openings 29A which engage with a pair of pins 27A and are arranged according to both the shelf number from the top and the position number from the left. That is, a pair of the engaging openings 29A are formed so as to face a pair of openings 24A whereinto a pair of pins 27A are inserted on the number setting portions 20A and 20B of the corresponding drug dispensing cartridge 3.

In the above mentioned structure, the drug dose is not erroneously dispensed from the cartridge 3 placed improperly on one of the shelves 2. An operator can find out about an incomplete engagement between the pins 27A and the engaging openings 29A in advance, in the case already described, wherein the cartridge 3 has a lower case 22 with a plurality of openings 24 arranged in a circular state at regular intervals. Also an improper placement of the cartridge 3 on one of the shelves 2 can be previously prevented through the confirmation of the pin positions on both number setting portions 20A and 20B of the cartridge 3.

Figure 26:
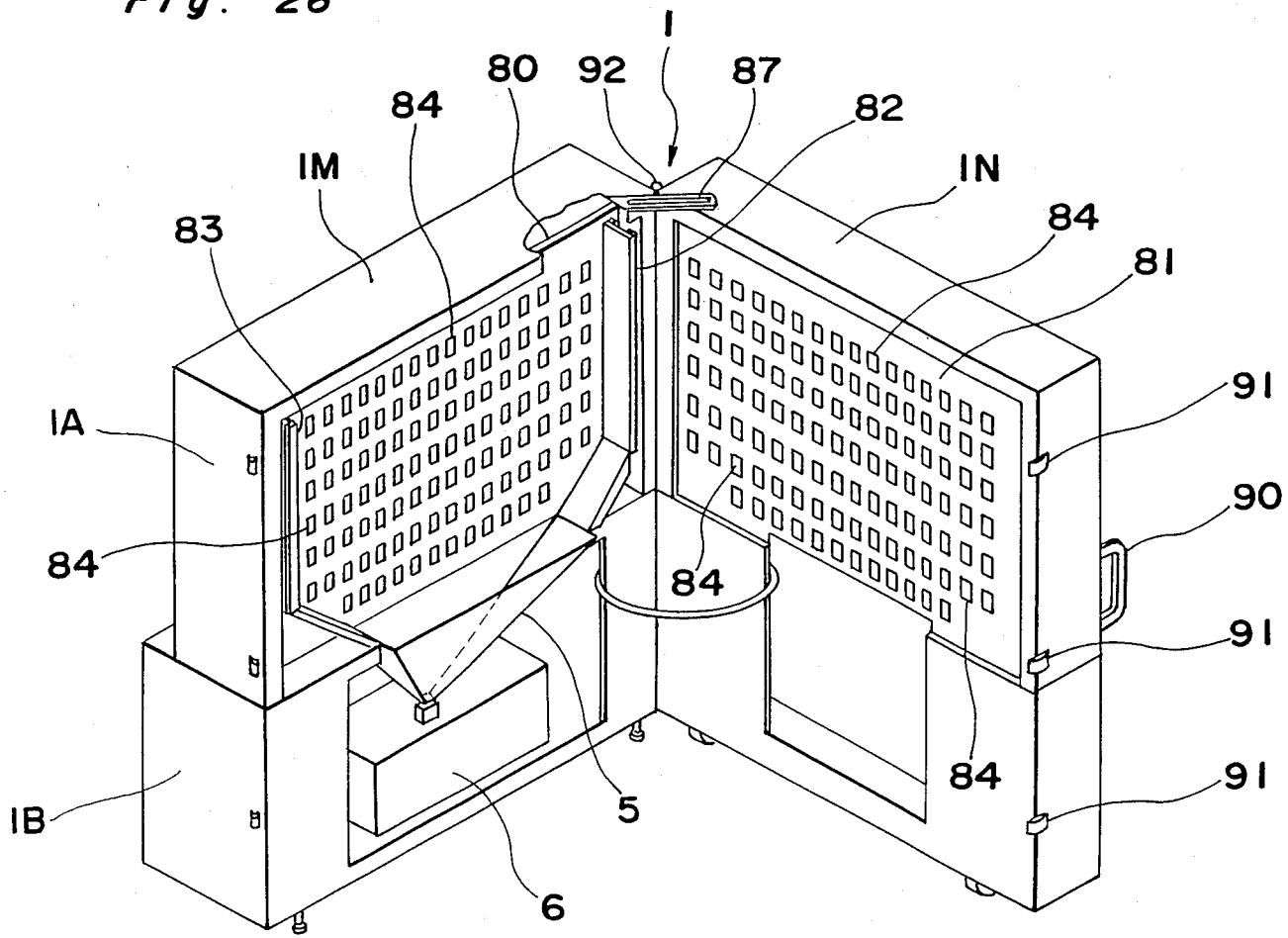
FIG. 26 is a perspective view of the drug dispensing unit of the apparatus separated into two units.
Figure 27:
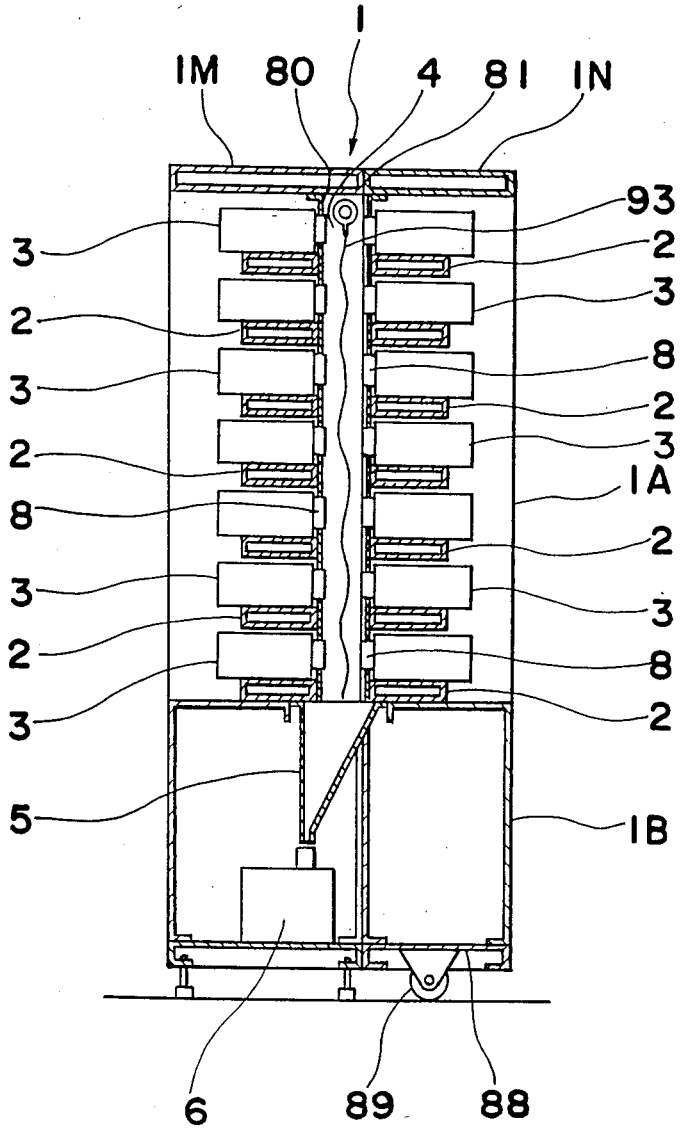
FIG. 27 is a side sectional view of the drug dispensing unit of the apparatus joined in one unit.

With regard to the drug dispensing unit including the drug dispensing cartridges storing unit 1A and the drug doses packing unit 1B, FIGS. 26 and 27 show an example wherein the dispensing unit is divided into two units. That is, the first drug dispensing unit 1M and the second drug dispensing unit 1N along the drug doses falling passage 4 is arranged vertically therein.

According to the present example, both of the above described units 1M and 1N, connected hingedly, are freely openable within the range defined by a stopper 87 with the second drug dispensing unit 1N as a turning side. Both units have a roller 89 for rotation under a bottom plate 88 thereof, a handle 90 and a plurality of locking devices 91.

A parting curtain 93 is provided in the drug doses falling passage 4 so that each drug dose discharged from one of the cartridges 3 falls along the parting curtain 93 without collision thereof against the cartridges 3.

As illustrated in FIG. 26, when the drug doses falling passage 4 is opened by turning the second unit 1N for separation from the first unit 1M, back plates 80 and 81 and guide walls 82 and 83, each forming one of said walls of the drug doses falling passage 4, are easily accessible for cleaning.

Although, in the present example, the drug dispensing cartridges storing unit 1A and the drug doses packing unit 1B are formed in one united body in each of the first and second drug dispensing units 1M and 1N respectively, with the hopper 5 and the packing mechanism 6 being accommodated in the first unit 1M, such a modification can be adopted that the drug dispensing unit comprises the cartridges storing unit 1A separable into two units and the drug doses packing unit 1B united in one body.

In addition, the first and second drug dispensing units 1M and 1N respectivley, can be separated not only in the turning style as described above, but also in a sliding style wherein both units 1M and 1N are slidingly separated in a parallel or perpendicular direction with respect to a separating face between the two, or in a lifting up style wherein both units 1M and 1N, hingedly connected at an upper or a lower side thereof are pivotally separated.

It is to be noted here that in the foregoing embodiment, the drug dispensing cartridges storing unit 1A has a plurality of shelves 2 arranged in two rows, one behind the other, and the drug doses falling passage 4 formed between the front and rear rows of the shelves, but the cartridges storing unit 1A may be so designed so that a plurality of shelves 2 are vertically arranged in only one row therein, with the front side thereof being opened and the drug doses falling passage 4 being formed between the shelves 2 and a rear plate of the cartridges storing unit 1A.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A drug dispensing apparatus having a drug dispensing cartridges storing unit, a drug doses packing unit and a control means for dispensing and packing an individual drug dose or doses in compliance with input information, and a plurality of drug dispensing cartridges accommodated in said storing unit, each of said drug dispensing cartridges comprising:

a driving motor;

a driven pulley, rotating while being driven by the driving motor;

a drug storing portion;

a rotary plate mounted on the same shaft as the driven pulley while facing the drug storing portion at one side thereof;

a guide wall having a plurality of notches at regular intervals formed on a circumference of the rotary plate at the other side thereof;

a plurality of claw pieces each mounted on the rotary plate so as to be reciprocable in a radial direction from a central shaft of the rotary plate corresponding to one of said notches;

a plurality of ribs arranged at regular intervals on a circumference of the rotary plate at a side facing the drug storing portion;

a plurality of engaging members mounted on the rotary plate, each having a receiving portion for each drug dose and corresponding to an opening between adjacent ribs so as to be capable of holding and pushing out each drug dose upon reciprocation thereof in a radial direction;

a parting strip arranged between the rotary plate and the drug storing portion, and having a circular opening so that the drug doses can be easily led to inside of each rib;

a stationary wall provided on said parting strip, along just inside of which the ribs rotate while facing the parting strip;

a drug outlet formed on said stationary wall at a position for taking out the drug doses;

a detecting means for detecting each drug dose discharged from the drug outlet; and a control means for controlling the reciprocating movement of the engaging member inwardly pressed toward the central shaft of the rotary plate thereby, said reciprocating movement of the engaging member following the rotation of the rotary plate so that the engaging member which has come to a position for taking out the drug dose through the rotation of the rotary plate can protrude toward the drug outlet through the opening between adjacent ribs.

2. A drug dispensing apparatus as claimed in claim 1, wherein each of a plurality of drug dispensing cartridges accommodated in a cartridges storing unit of said apparatus, further comprises a plurality of guide plates, each arranged along a travelling passage of the receiving portion which follows the reciprocating motion of the engaging member so as to hold each drug dose in combination with the receiving portion of the engaging member.

3. A drug dispensing apparatus as claimed in claim 1, wherein said driving motor in the drug dispensing cartridge is capable of turning around a supporting shaft thereof in the same direction as a rotating direction of an output shaft thereof.

4. A drug dispensing apparatus as claimed in claim 1, wherein each of a plurality of engaging members in the drug dispensing cartridge is made up of a plate, a portion or portions of which are bent one or more times so as to form a receiving portion for each drug dose.

5. A drug dispensing apparatus as claimed in claim 1, wherein said parting strip in the drug dispensing cartridge has a circular opening with a smaller diameter than that of the rotary plate.

6. A drug dispensing apparatus as claimed in claim 1, wherein said parting strip in the drug dispensing cartridge has a circular opening with approximately the same diameter as that of the rotary plate.

7. A drug dispensing apparatus as claimed in claim 1, wherein said detecting means in the drug dispensing cartridge is composed of an elastic member having a shielding plate, a reed switch and a magnet.

8. A drug dispensing apparatus as claimed in claim 1, wherein said control means includes a spring urging the claw piece outwardly in a radial direction at all times, a roller mounted on the claw piece and a cam having an inner circumferential wall on and along which said roller moves, while keeping in contact therwith.

9. A drug dispensing apparatus internally accommodating a plurality of drug dispensing cartridges for dispensing and packing an individual drug dose or doses discharged thereform in compliance with input information, said drug dispensing apparatus comprising:

front and rear drug dispensing units forming front and rear sides of said apparatus;

a plurality of drug dispensing cartridges each having drug dispensing outlets;

a plurality of shelves each having a front face and an upper face, said shelves being vertically arranged within each of said front and rear dispensing units for placing said plurality of drug dispensing cartridges side by side on each of said shelves;

a set of back plates disposed on said front and rear drug dispensing units on respective sides thereof facing each other, with a drug doses falling passage being defined between said back plates;

a plurality of first connectors disposed on said front faces of said shelves;

a lower casing disposed on each drug dispensing cartridge at a part of its bottom portion so as to protrude downwardly therefrom and to be held out of contact with said upper face of any one of said shelves but in contact with said front face thereof when said drug dispensing cartridge is set thereon from the front face side thereof; and a second connector disposed on said lower casing of each drug dispensing cartridge for being electrically connected with any one of said first connectors when said drug dispensing cartridge is set on said upper face of one of said shelves, wherein a plurality of openings is defined on each of said back plates so that said drug outlets defined on respective drug dispensing cartridges face said drug dose falling passage, when said drug dispensing cartridges are set on said upper faces of said shelves.

10. A drug dispensing apparatus as claimed in claim 9, wherein said second connector includes a set of coupling groups disposed on said lower casing of each drug dispensing cartridge on its face facing one of said shelves, each of said coupling groups including a plurality of openings in a circular state and a pin capable of being selectively inserted into any one of said openings; and said first connector includes a set of engaging opening groups defined on each of said shelves on its contact face with said drug dispensing cartridge, any one opening of each engaging opening group being capable of receiving said pin therein only in the case where said pin is held in an appointed opening of said ddrug dispensing cartridge so that said drug dispensing cartridge is placed at its corresponding position on said shelves;

where said drug dispensing cartridge is electrically connected to said drug dispensing apparatus through complete engagement between both pins of said coupling groups and respective appointed openings of one of said shelves.

11. A drug dispensing apparatus as claimed in claim 9, wherein said second connector includes a set number setting portions disposed on said lower casing of each drug dispensing cartridge on its face facing one of said shelves each of said number setting portions including a plurality of openings in a matrix-like state and a pin capable of being selectively inserted into any one of said openings; and said first connector includes a set of engaging opening groups defined on each of said shelves on its contact face with said drug dispensing cartridge, any one opening of each engaging opening group being capable of receiving said pin thereinto only in the case where said pin is held in an appointed opening of said drug dispensing cartridge so that said drug dispensing cartridge is placed at its corresponding position on said shelves;

wherein said drug dispensing cartridge is electrically connected to said drug dispensing apparatus through complete engagement between both pins of said number setting portions and respective appointed openings on one of said shelves, with said number setting portions respectively indicating the number of the shelf on which said drug dispensing cartridge is placed and the position number on said shelf by said openings of said shelf having received said pins therein.

12. A drug dispensing apparatus as claimed in claim 9, further comprising a parting curtain provided in said drug doses falling passage, wherein each drug dose discharged from one of said drug dispensing cartridges drops along said parting curtain without collision thereof against other drug dispensing cartridges disposed on opposite sides of said one of drug dispensing cartridges.

* * * * *